United States Patent [19]

Kaiser

[11] 4,199,138

[45] Apr. 22, 1980

[54] GYMNASTICS AND GAME APPARATUS

[75] Inventor: Benno Kaiser, Roxel, Fed. Rep. of Germany

[73] Assignee: Gerätebau Albin Grunzig & Co., Eystrup, Fed. Rep. of Germany

[21] Appl. No.: 860,943

[22] Filed: Dec. 15, 1977

[30] Foreign Application Priority Data

Dec. 30, 1976 [DE] Fed. Rep. of Germany ..... 7641066
Mar. 15, 1977 [DE] Fed. Rep. of Germany ..... 2711104

[51] Int. Cl.[2] ..... A63B 9/00
[52] U.S. Cl. ..... 272/113
[58] Field of Search ..... 272/62, 63, 112, 109, 272/113, 144; 46/24-29

[56] References Cited

U.S. PATENT DOCUMENTS 3,982,754 9/1976 de Moreau ..... 272/112

FOREIGN PATENT DOCUMENTS 572267 11/1958 Belgium ..... 272/113
38542 4/1927 Denmark ..... 272/109
177704 2/1954 Fed. Rep. of Germany ..... 272/109
2641345 3/1977 Fed. Rep. of Germany ..... 272/109

*Primary Examiner*—William R. Browne
*Attorney, Agent, or Firm*—Toren, McGeady and Stanger

[57] ABSTRACT

A gymnastics and game apparatus formed of a plurality of large-scale structural members made of a plastic material in a box-shaped elongate configuration having patterns of recesses in the form of mortise openings and grooves in at least two opposite longitudinal lateral walls, and plug connectors for interconnecting structural members or attaching various elements such as bars, rods or the like to the structural members, the plug connectors having a configuration mating the mortises and grooves on the structural members.

11 Claims, 13 Drawing Figures

GYMNASTICS AND GAME APPARATUS

The present invention relates to a gymnastics and game apparatus. Some heretofore known gymnastics and game apparatus consist of large-scale structural members the dimensions of which may for example be adapted to the size of the child's body, in allowing a child to either creep into a hollow member of this type or to employ such a member as a seat. Elements of this type may likewise be stacked one upon the other, for assembling e.g. a playground environment. It is likewise known to provide elements in designs facilitating combining the elements, and the corresponding means may e.g. consist of projections on an element adapted to engage corresponding recesses in another element. Assemblies of this type are, however, relatively unstable. The type of assembly if likewise restricted by the number of mating engaging members.

It is now the object of the present invention to provide a novel and improved gymnastics and game apparatus that allows to assemble, from simple elements, not only a large number of different bodies but to utilize such bodies likewise as parts of gymnastics apparatus whereby with respect to heretofore known elements of this type the rigidity of assembly is improved, due to a unique design of the interconnecting members, and there is offered an increased variety of applications.

In accordance with the present invention, this object is achieved in a gymnastics and game apparatus comprising a plurality of elongate hollow members made of a plastic material, each hollow member having four longitudinal lateral walls and two face walls, equal patterns of recesses in at least two opposite longitudinal lateral walls, mortises in these recesses, the mortises extending through the plastics hollow body intermediate opposite longitudinal lateral walls and being provided with grooves at these longitudinal lateral walls, box-shaped cavity wall members of the hollow plastics members provided intermediate the recesses, a plurality of plug connectors including stub rods adapted to engage the mortises, and transverse tenons adapted to engage the grooves when inserting the stub rods into the mortises, the transverse tenons being adapted to be received by half of their cross section by a groove, and free grooves not occupied by plug connectors for receiving gymnastics elements having rod type end portions.

Stub rods of the plug connectors may be engaged into the mortises at the recesses. Between adjacent hollow plastics members, the tenons will be surrounded completely by the grooves. Preferably, the grooves extending from the mortises toward the edges of the lateral walls of the large-scale structural members are of substantially the same lengths as the ten-ons. This allows to guide the inserted stub rods in a simple manner by means of the grooves and the tenons so that the stub rods need not be guided with respect to the length of their insertion into a large-scale structural member. The large-scale structural members may be made in a relatively simple manner.

The grooves transverse of the longitudinal extension of the structural members are provided in a regular pattern, i.e. at equal spacings, and provide through-openings when assembling two large-scale structural members. The through-openings are each defined by two opposite grooves and serve to receive other structural members such as horizontal gymnastics bars, climbing bars or the like.

Advantageously, the recesses with the mortises define central depressions for receiving a marking element such as a ball. This provides the pre-requisite for a particular application that will be described further below.

Advantageously, the plug connectors consist of stub rods from which project laterally tenons in a position intermediate the length of the stub rod. The tenons are adapted to the configuration of the grooves, and the cross-sectional profile of a tenon is substantially about twice the cross-sectional profile of a groove. The present invention thus provides unique plug connectors for the gymnastics and game apparatus.

In a preferred embodiment at least one of two mutually aligned tenons disposed on opposite sides of the plug connector is provided with a longitudinal bore. This serves the purpose of providing guide members for specific horizontal bars adapted to be secured by plug connectors within an assembly of box-shaped large-scale structural members. These specific horizontal bars may be made of metal and adapted to be introduced, by their end portions, into the tenons serving as bearing bushes. Preferably, the horizontal bars are secured against rotation by pins within the bearing bush-defining tenons, and the tenons are secured against rotation on a stub rod.

According to another embodiment of the present invention, the stub rods are provided with a center transverse, bore, and the tenons consist of the end portions of a rod inserted into this transverse bore. This rod may be replaceable, in order to provide the possibility of likewise inserting a bar into the bore whereby this bar will of course be of a cross-section corresponding to half a groove cross section.

In a suitable embodiment the stub rods are provided with peripheral annular grooves adjacent their end portions.

It is particularly advantageous to provide the large-scale structural members as hollow members made of a plastic material having recesses in their upper and lower lateral walls and box-shaped cavity wall members intermediate the recesses. With small wall thicknesses this arrangement provides a considerable rigidity and torsional and bending strength, and these properties may be enhanced in an assembly with other structural members by the unique plug connectors of the present invention consisting of stub rods and tenons because the tenons provide for retention or respectively alignment at a corresponding wall by engagement into the recesses. This arrangement in fact constitutes a unique functional design assembly of large-scale structural members and plug connectors cooperating for increased stability and alignment.

Suitably, any apertures due to the manufacturing process in the box-shaped cavity wall members will be subsequently sealed so that the large-scale structural members are adapted to float. This constitutes another advantage because the large-scale structural members are assemblies of such members may be employed as floats.

It is particularly advantageous when the lateral walls of the large-scale structural members having the recesses are provided with longitudinal grooves between the mortises. This allows to engage the plug connectors so that the projecting tenons extend in the longitudinal direction of the large-scale structural member. Preferably, the transverse grooves at the mortises are of half the length as the longitudinal grooves between the mortises of the large-scale structural members. When the projecting tenons of the plug connectors are of the same length as the transverse grooves which is considered advantageous, these tenons may likewise be inserted into the longitudinal grooves extending in the longitudinal direction of the large-scale structural members to occupy these grooves intermediate adjacent mortises. On an upper wall surface of a large-scale structural member assembly may in this manner be formed abutments for adapters or the like by tenons extending in the longitudinal direction of the large-scale structural member, and these adapters may be provided with a recess corresponding to half a tenon cross-section at their supporting ends.

In an advantageous embodiment a plurality of large-scale structural members arranged side by side form a support for a marking game with balls whereby the grooves are provided substantially as guides for moving the balls to and fro between the mortises.

In the following, the present invention will be described more in detail with reference to several preferred illustrative embodiments shown in the appended drawings wherein.

Figure 4:
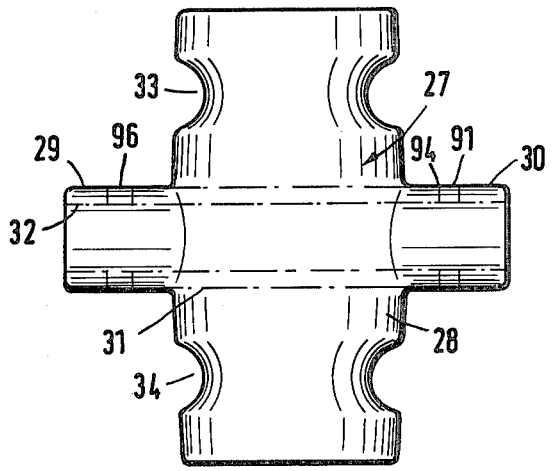
FIG. 4 is a lateral elevational view of a plug connector according to the present invention.
Figure 5:
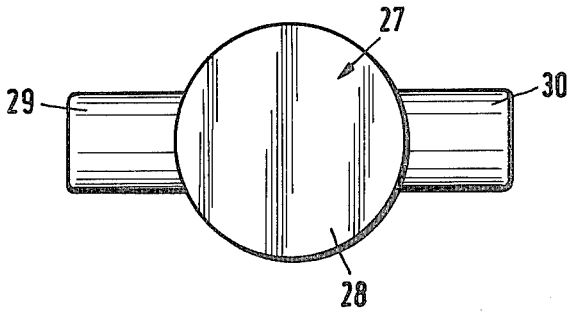

FIG. 4 *a* is a fragmentary view of a horizontal bar adapted to be inserted into a tenon of the plug connector of FIG. 4;

FIG. 5 is a top view of FIG. 4; and

FIGS. 6 to 10, 11*a* and 11*b* are perspective views of various assemblies of gymnastics and game apparatus.

Figure 2:
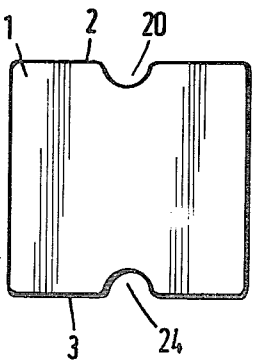
FIG. 2 is an end elevational view of FIG. 1.
Figure 1:
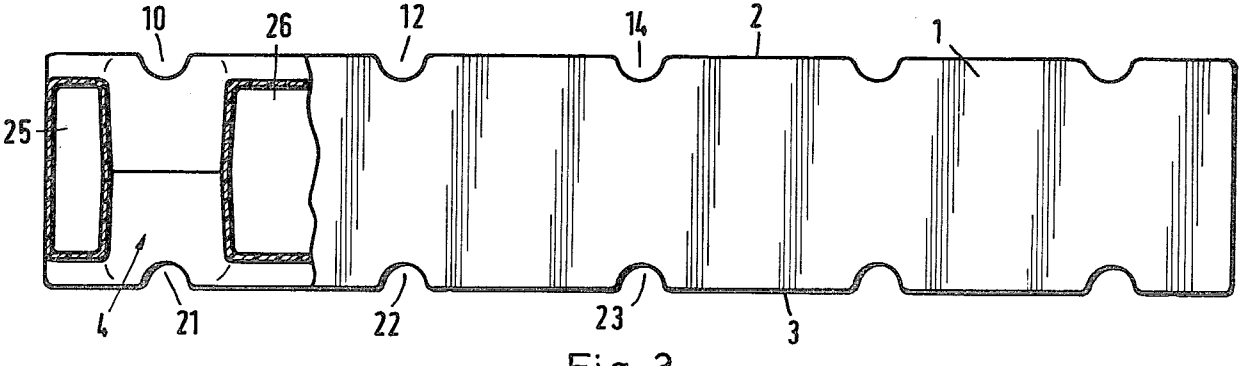
FIG. 1 is a partly sectional lateral elevational view of a large-scale structural member according to the present invention.
Figure 3:
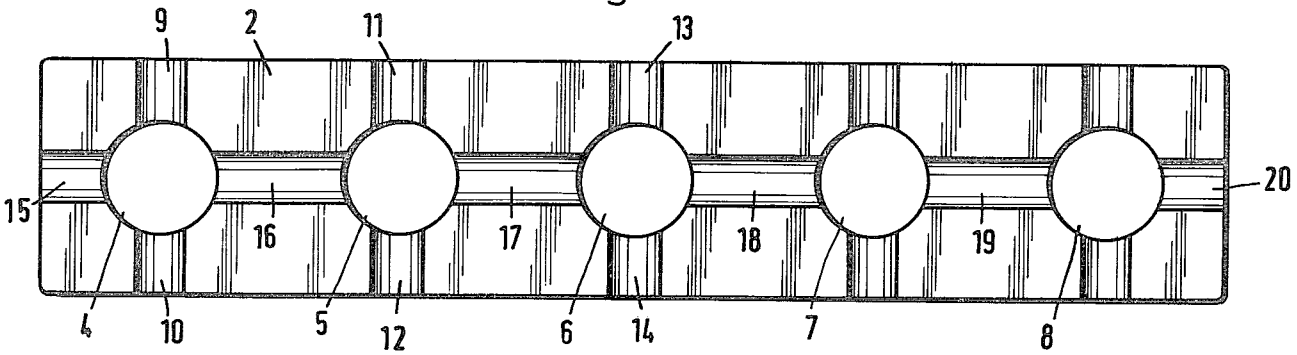
FIG. 3 is a top view of FIG. 1.

Referring to FIGS. 1 to 3, a box-shaped large-scale structural member 1 is provided with recesses in its upper lateral wall 2 and its lower lateral wall 3. These recesses are provided with mortises 4–8 at regular spacings along the length of the structural member. These recesses consist of transverse grooves 9–14 extending from the mortises toward the edges of the upper lateral wall, and grooves 15–20 extending in the longitudinal direction of the upper wall and the lower wall 3 between the mortises 4–8 and up to the face walls. The transverse grooves in the lower lateral wall 3 are indicated by references 21–23, and the longitudinal grooves extending to the face wall by 24 in FIG. 2. Of the transverse grooves, only part of the grooves is indicated by reference numerals; and the other grooves extend at the same spacings and lengths across the length of a lateral wall of every large-scale structural member.

The mortises 4–8 are mutually spaced so that the intermediate longitudinal grooves 16–19 are twice the length of the transverse grooves 9–14 or respectively of the end portions 15 and 20 of the longitudinal grooves extending up to the face walls.

The large-scale structural members are made of hollow members made of a plastic material having box-shaped cavity wall members 25, 26 intermediate the recesses. These box-shaped cavity wall members likewise include the other two pairs of lateral walls that extend perpendicularly of the lateral walls 2, 3 and the face walls and provide the large-scale structural members, even at a small wall thickness, with a considerable rigidity and torsional and bending strength. Since apertures due to the manufacturing process in the box-shaped large-scale structural members are sealed, the members are adapted to float according to a preferred embodiment.

The plastics structural members 1 include, on opposite longitudinal lateral walls, the recesses with the mortises 4–8 and the grooves 9–20 whereby the mortises extend through the whole depth of the structural member, as shown e.g. for the mortise 4 in FIG. 1.

Several large-scale structural members may be assembled in a manner described further below by means of plug connectors 27 shown in FIGS. 4 and 5. These plug connectors consist of stub rods 28 of a cross-section substantially corresponding to the cross-section of the mortises 4–8, in order to allow the same to engage the mortises. These stub rods include projecting tenons 29, 30 extending centrally along a diameter. The tenons 29, 30 are of a length corresponding to the length of the transverse grooves 9–14 or respectively the end longitudinal grooves 15, 20. In a particular embodiment the tenons 29, 30 are integral and consist of the ends of a through-rod that is inserted into a corresponding through-bore 31 of the stub rod 28. These through-rods may be secured by suitable screws or splints (not shown).

In another advantageous embodiment the plug connector 27 is provided with an internal bore 32 extending in the direction of the mutually aligned tenons 29, 30, and into which bore 32 may be inserted a horizontal bar or the like. In this context, a special assembly consists of a horizontal bar provided at its ends with plug connectors one tenon 29 or 30 of which is provided with a longitudinal bore, and the end portion of the horizontal bar is inserted into this blind bore and secured against rotation by a pin.

Figure 4A:
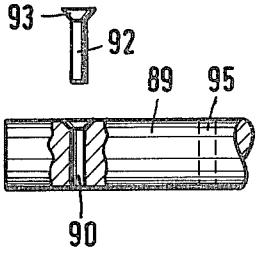

FIG. 4*a* illustrates an end portion of a horizontal bar 89. This end portion is provided with a through-bore 90 extending along a diameter of the bar and being spaced from the end surface of the end portion. In the tenon 30 is likewise provided a through-bore 91 spaced from the end thereof. After inserting the horizontal bar 89, the bar may be secured in an axial direction and against rotation by a pin 92 having suitably an enlarged head portion 93 engaging a mating recess 94 at the upper end of the through-bore 91. For securing, the pin may of course be likewise provided with wedge type widened portions at both ends. The end portion of the horizontal bar 89 may likewise be inserted so far that the horizontal bar having two bores 90, 95 may be secured by corresponding pins in the through-bore 91 or 96, and the latter within the tenon 29.

The stub rod may also be provided with peripheral annular grooves 33, 34 adjacent its ends. These grooves facilitate manipulation thereof.

The stub rod 28 is with respect to the center line of the tenons 29, 30 of a length so that the stub rod may be inserted into the mortises 4–8 at the most up to the center line of the large-scale structural members 1. By this expedient, it is possible to introduce plug connectors 27 from both sides into a mortise 4 whereby the engagement positions are predetermined by engagement of the tenons 29, 30 in grooves such as grooves 9, 10 and 15, 16.

Since the tenons 29, 30, by their half circumference engagement into grooves of a large-scale structural member, serve additionally as guides between adjacent large-scale structural members, there is likewise ensured that angular rigidity of the assembly.

Figure 6:
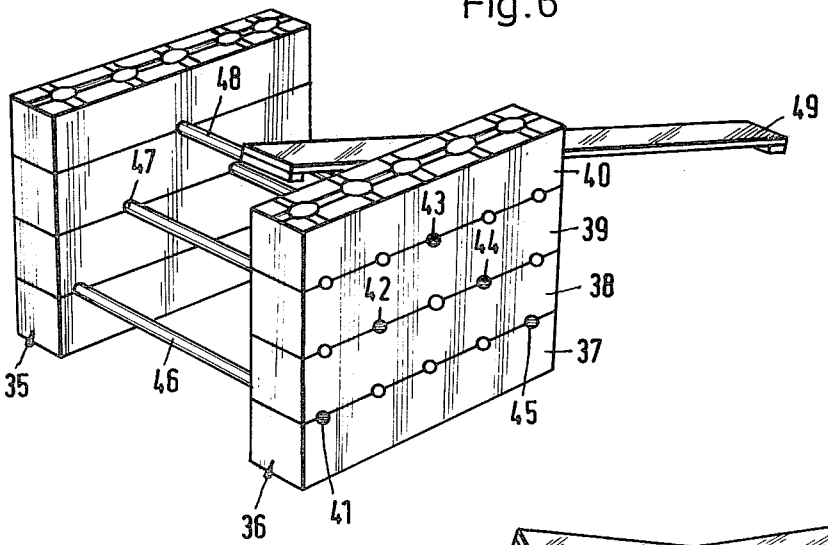

Referring to FIG. 6, there is shown an embodiment in which two wall assemblies 35, 36 each consist of four stacked large-scale structural members 37–40 interconnected internally by plug connectors in a manner described further below with respect to FIG. 7. In transverse grooves 41–45 are arranged plug connectors of the described type with horizontal bars 46–48, in defining a climbing structure with non-rotatably secured bars. This greatly increases the security with respect to an embodiment having no plug connectors at the grooves 41–45 but merely bars 46–48 inserted into openings defined by adjacent grooves.

The climbing structure may in use also be provided with a running board 49.

Figure 7:
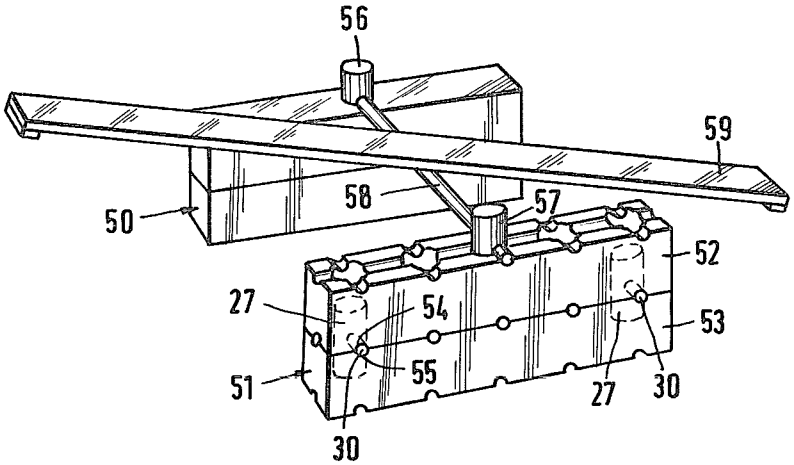

Referring to FIG. 7, there are provided two wall assemblies 50, 51 whereby the plug connectors 27 interconnecting the large-scale structural members 52, 53 are indicated in broken lines schematically. The transverse tenons, one of which such as tenon 30 is shown engage adjacent transverse grooves 54, 55 in the adjacent upper and respectively lower surfaces of the structural members 52. 53. This provides for a rigid assembly.

As shown in FIG. 7, stub rods 56, 57 may engage mortises in a center region. From these stub rods has been removed the transverse tenon, and into the free bore 31 (FIG. 4) have been introduced the ends of an elongate cross bar 58 interconnecting the wall assemblies and serving e.g. as a support for a seesaw 59. In this assembly, there is likewise preferred the above described assembly of horizontal bars or cross bars the ends of which are secured against rotation in the stub rods 56, 57.

Figure 8:
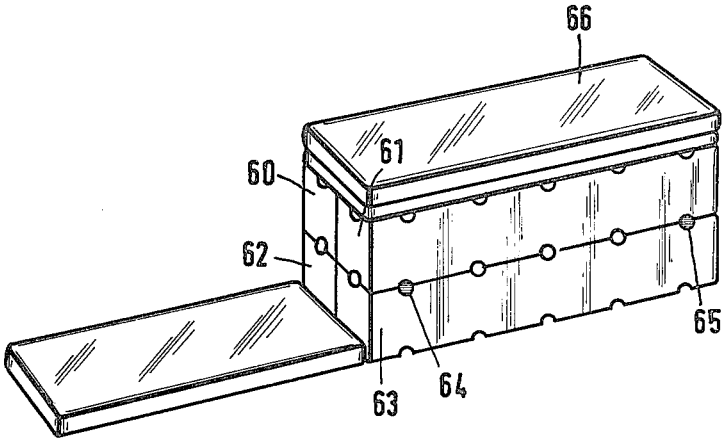

FIG. 8 illustrates the assembly of a chest of four large-scale structural members 60–63 interconnected by plug connectors tenons of which may be seen at the points 64, 65. The upper surface of the chest is covered e.g. by a padded plate 66 having at its lower surface adjacent its corners cylindrical adapter members corresponding to the stub rods and being mutually spaced according to the dimensions of the large-scale structural members. These adapter members engage corresponding mortises at the upper side of the large-scale structural members 60,61 at the corners of the chest, in establishing a rigid compound.

Figure 9:
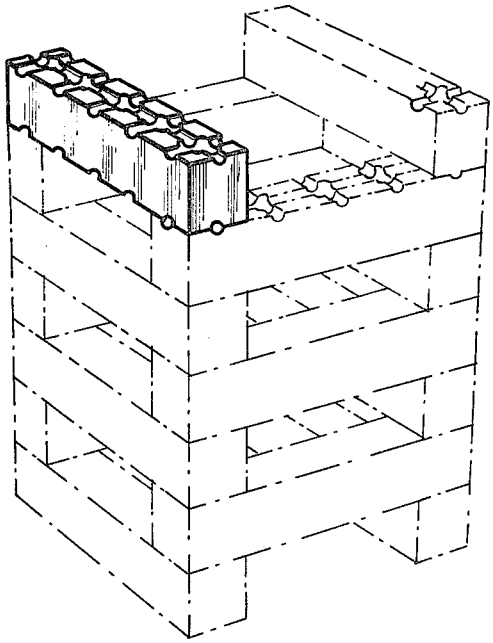

Another example of an assembly is shown in FIG. 9 in which large-scale structural members are stacked in pairs on top of each other whereby each layer is rotated by 90° with respect to the layer underneath. At the mutually adjacent recesses, particularly the mortises, the members are interconnected by plug connectors.

Figure 10:
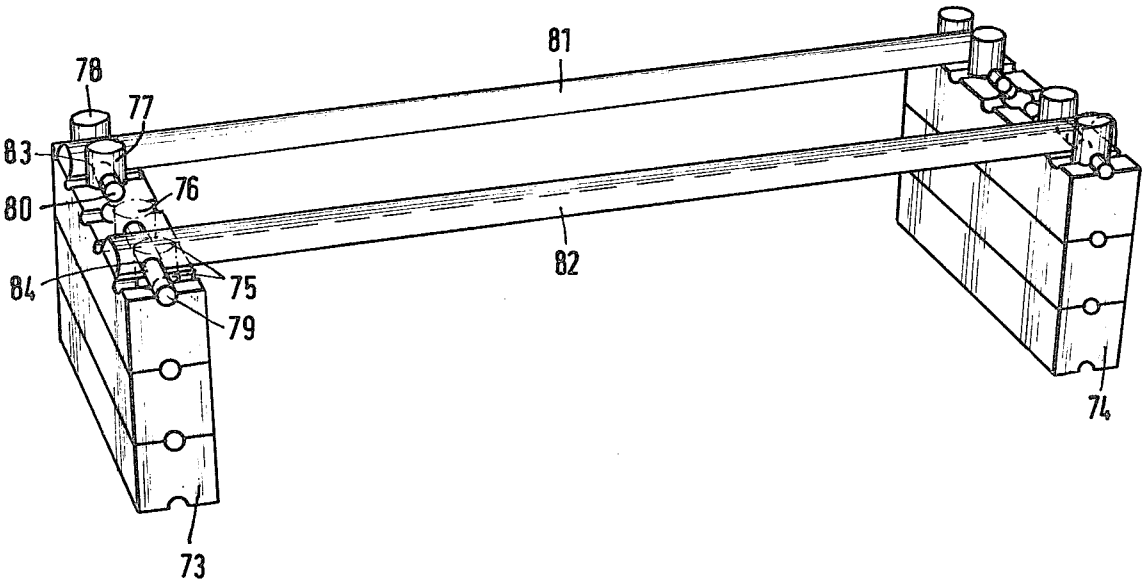

In FIG. 10 is shown a modification with two wall assemblies 73, 74 consisting each of three large-scale structural members. Plug connectors 57, 56 and 77, 78 respectively are inserted into the top structural members of the two wall assemblies so that the tenons 79, 80 extend in longitudinal grooves (15–20 in FIG. 3). This arrangement allows to place balancing bars 81, 82 onto the tenons that project by half of their cross-section beyond the upper surface of the wall assemblies and have at their ends recessed portions 83, 84 corresponding to half the cross-section of the tenons. This provides another advantage for the selective employment of the plug connectors with tenons extending either in the transverse or in the longitudinal directions for grooves are provided in both directions.

Figure 11B:
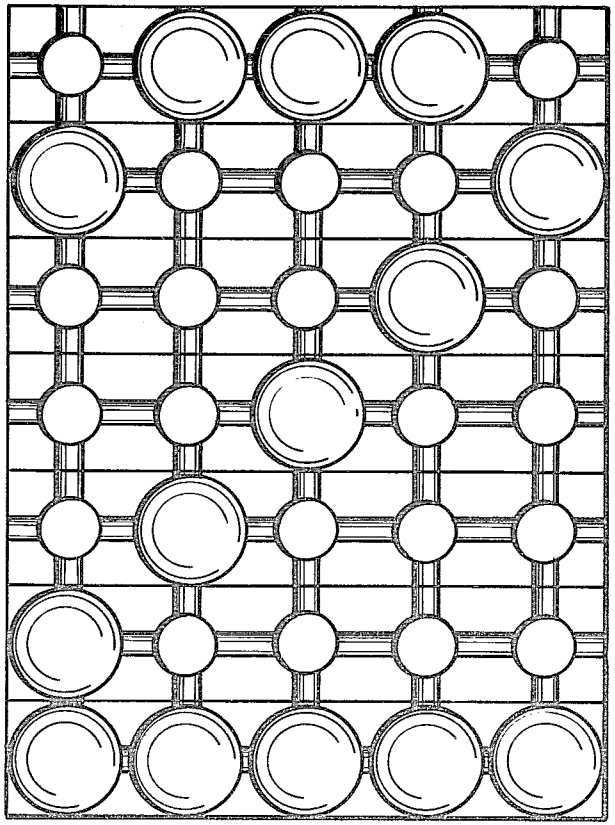
Figure 11A:
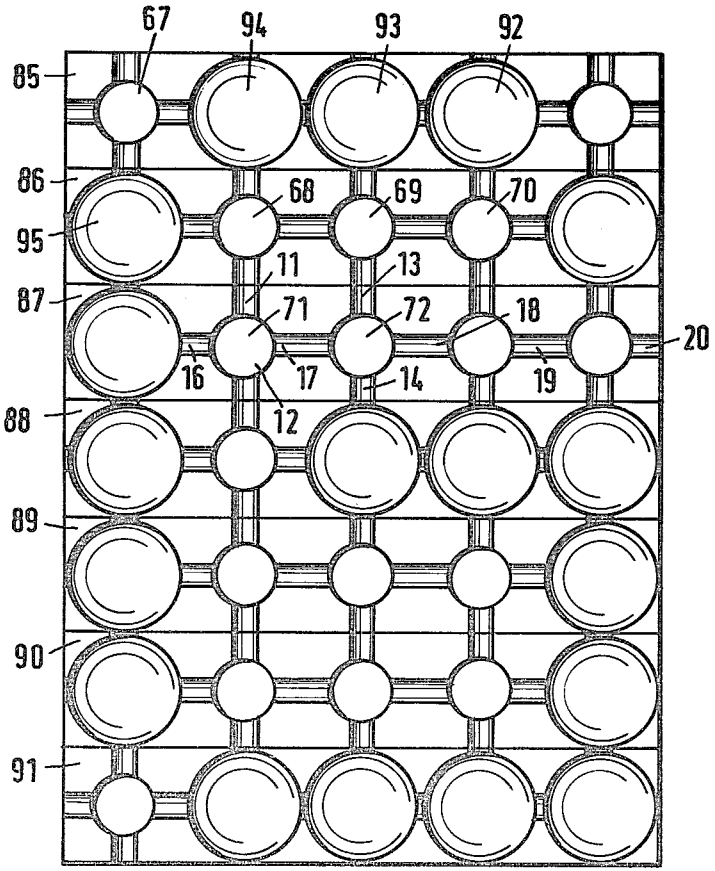

According to FIGS. 11*a* and 11*b* seven large-scale structural members 85–91 are arranged side by side. The mortises, some of which are indicated by 67, 68, 69, 70, 71, 72 define, due to their depressions, releasable support cups for balls 92, 93, 94, 95, . . . . This arrangement allows positional games. In the illustrated embodiment, the numbers 6 and 2 have been laid out. Letters may be defined in a corresponding manner.

With this embodiment the large-scale structural members are suitably provided at all four lateral walls with the described recesses for receiving plug connectors. This allows to establish a rigid assembly for a ball marking game whereby the grooves which in the large-scale structural member 87 are indicated e.g. by 11, 12, 13, 14, . . . 16–20 join at least for the transverse grooves 11–14 corresponding transverse grooves of adjacent large-scale structural members 86, 88 and thus serve as guides for moving the balls to and fro between mortise openings.

What is claimed is:

1. A gymnastics and game apparatus comprising a plurality of elongate box-shaped hollow members made of a plastic material and forming large scale structural members, each said hollow member having four longitudinal lateral walls extending in the elongate direction thereof and forming a closed rectangular cross section and two face walls each at an opposite end of said lateral walls and disposed transversely of the elongate direction of said hollow member, a first recess in each of an oppositely disposed pair of said lateral walls extending in the elongate direction of said hollow member with said first recess spaced inwardly from the longitudinally extending edges of said lateral wall, a plurality of second recesses in each of said pair of lateral walls containing said first recess and extending transversely of the elongate direction of said hollow member and spaced apart in the elongate direction, said second recesses extending transversely across said first recess in the same said lateral wall and forming a number of recess intersections therein, said first and second recesses formed in the outwardly facing surfaces of said pair of lateral walls with the openings of said recesses facing outwardly, each said hollow member forming a plurality of mortises with each mortise extending therethrough between each of the recess intersections in said pair of lateral walls containing the first and second recesses so that the first and second recesses extend from said mortises, a number of box-shaped closed cavity wall members located in each of said hollow plastics members with said closed cavity wall members located between adjacent pairs of said second recesses, a plurality of plug connectors each comprising an axially extending stub rods adapted to fit into one of said mortises, and a pair of axially elongated tenons extending transversely of and outwardly from said stub rod and adapted to seat into one of said first and second recesses when the associated said stub rods is fitted into one of said mortises, half of the transverse cross section of each said tenon being adapted to seat in one of said first and second recesses, and said first and second recesses free of said plug connectors arranged to receive gymnastics elements having rod type end portions.

2. A gymnastics and game apparatus as defined in claim 1 wherein said tenons project laterally outwardly from said stub rod intermediate the length of the stub rod, and at least one of said tenons having a bore extending in the axial direction thereof.

3. A gymnastics and game apparatus as defined in claim 1 wherein the portions of said second recess extending from said mortises toward the edges of said lateral walls and the portions of said first recess entering from said mortises to the adjacent said face walls are of substantially the same lengths as said tenons.

4. A gymnastics and game apparatus as defined in claim 1 wherein said stub rods are provided with a bore extending transversely of the axis of and along a diameter of said stub rod, and said tenons comprise tubular end portions inserted into said bore in said stub rod.

5. A gymnastics and game apparatus as defined in claim 4 wherein a gymnastics bar is inserted into said tubular end portions of said tenons.

6. A gymnastics and game apparatus as defined in claim 5 wherein pins extend transversely through said tubular end portions of said tenons for securing said gymnastic bar against rotation, and said tenons are secured against rotation in said stub rod.

7. A gymnastics and game apparatus as defined in claim 4, including a pair of laterally spaced large scale structural members, a plug connector in each said structural member with said plug connectors located opposite one another, a horizontal bar extending between said plug connectors, one said tenon in each said plug connector being provided with an axial blind bore, and the ends of said horizontal bar being inserted into the blind bores, and a pin extending transversely through said tenon into the blind bore therein for securing said horizontal bar against rotation.

8. A gymnastics and game apparatus as defined in claim 1 wherein said box-shaped closed cavity wall members are sealed, and said hollow members are made of a plastic material whereby said hollow members are capable of floating in water.

9. A gymnastics and game apparatus as defined in claim 1 wherein said first and second recesses in combination with said mortises define central depressions for receiving a marking element such as a ball.

10. A gymnastics and game apparatus as defined in claim 9 wherein a plurality of said large-scale structural members are arranged with said lateral walls thereof in side by side relation forming a support for a marking game with balls whereby said first and second recesses are provided substantially as guides for moving the balls to and fro between said mortises.

11. A gymnastics and game apparatus as defined in claim 1 wherein a chest assembled from a plurality of said large-scale structural members, a plurality of plug connectors interconnect said structural members, an upper padded plate forming a cover for said chest, cylindrical adapters corresponding in shape to said stub rods attached to the lower surface of said padded plate, said adapters spaced apart in accordance with the spacing of at least certain of said mortises in said structural members and said adapters being fitted into said mortises.

* * * * *